US007871474B2

(12) United States Patent
Unoki et al.

(10) Patent No.: US 7,871,474 B2
(45) Date of Patent: Jan. 18, 2011

(54) METHOD FOR MANUFACTURING OF INSULATED SOFT MAGNETIC METAL POWDER FORMED BODY

(75) Inventors: Kenichi Unoki, Fukushima (JP); Kenichi Nagai, Fukushima (JP); Shoichi Yamasaki, Fukushima (JP); Yuji Soda, Tochigi (JP)

(73) Assignee: Mitsubishi Steel Mfg. Co. Ltd., Tokyo (JP)

( * ) Notice: Subject to any disclaimer, the term of this patent is extended or adjusted under 35 U.S.C. 154(b) by 494 days.

(21) Appl. No.: 11/994,272

(22) PCT Filed: Jul. 3, 2006

(86) PCT No.: PCT/JP2006/313628

§ 371 (c)(1),
(2), (4) Date: Dec. 28, 2007

(87) PCT Pub. No.: WO2007/004727

PCT Pub. Date: Jan. 11, 2007

(65) Prior Publication Data

US 2009/0116990 A1 May 7, 2009

(30) Foreign Application Priority Data

Jul. 1, 2005 (JP) ..... 2005-193892

(51) Int. Cl.
*H01F 1/24* (2006.01)
*H01F 1/22* (2006.01)

(52) U.S. Cl. ..... 148/104; 148/122; 419/19; 419/35

(58) Field of Classification Search ..... None
See application file for complete search history.

(56) References Cited

U.S. PATENT DOCUMENTS

| | | | | |
|---|---|---|---|---|
| 3,666,571 | A * | 5/1972 | Laing et al. | 148/104 |
| 6,149,704 | A * | 11/2000 | Moro et al. | 75/230 |
| 2002/0014280 | A1 * | 2/2002 | Moro | 148/104 |
| 2002/0135089 | A1 | 9/2002 | Koch et al. | |
| 2004/0173287 | A1 * | 9/2004 | Iorio et al. | 148/104 |

FOREIGN PATENT DOCUMENTS

| | | | |
|---|---|---|---|
| DE | 3439397 | A1 | 4/1986 |
| DE | 10245088 | B3 | 1/2004 |
| JP | 7245209 | A1 | 9/1995 |
| JP | 9512388 | A1 | 12/1997 |
| JP | 2000232014 | A1 | 8/2000 |
| JP | 2004143554 | A1 | 5/2004 |
| JP | 2005015914 | A1 | 1/2005 |

* cited by examiner

*Primary Examiner*—John P Sheehan
(74) *Attorney, Agent, or Firm*—Knobbe Martens Olson & Bear LLP

(57) ABSTRACT

A method for manufacturing bodies formed from insulated soft magnetic metal powder by forming an insulating film of an inorganic substance on the surface of particles of a soft magnetic metal powder, compacting and molding the powder, then carrying out a heat treatment to provide a body formed from insulated soft magnetic metal powder the method comprising: compacting and molding the powder; then magnetically annealing the powder at a high temperature above the Curie temperature for the soft magnetic metal powder and below the threshold temperature at which the insulating film is destroyed in a non-oxidizing atmosphere, such as a vacuum, inert gas, or the like; and then carrying out a further heat treatment at a temperature of from 400° C. to 700° C. in an oxidizing atmosphere, such as air, or the like.

13 Claims, No Drawings

METHOD FOR MANUFACTURING OF INSULATED SOFT MAGNETIC METAL POWDER FORMED BODY

This application is U.S. National Phase of International Application PCT/JP2006/313628, filed Jul. 3, 2006 designating the U.S. and published in English as WO 2007/004727 on Jan. 11, 2007, which claims priority to Japanese Patent Application No. JP 2005-193892 filed Jul. 1, 2005.

TECHNICAL FIELD

The present invention relates to a method for manufacturing high-performance bodies formed from insulated soft magnetic metal powder, which are well suited to be used for motor cores and toroidal cores, and the like, as electric/electronic components, and relates to a method for manufacturing bodies formed from insulated soft magnetic metal powder, which are low in iron loss and high in magnetic permeability.

BACKGROUND ART

In recent years, with the increase in performance of electric/electronic components (higher efficiency and more compact size), and also for bodies formed from insulated soft magnetic metal powder used for motor cores, toroidal cores, and the like, it has been demanded that iron loss be decreased, and the magnetic permeability be increased. In order to enhance the magnetic permeability, a reduction in the thickness of the insulation layer to narrow the spacing between particles of soft magnetic metal powder is required. Iron loss is generally made up of hysteresis loss and eddy-current loss, and hysteresis loss varies depending upon the type of soft magnetic material, the concentration of the impurities, work stress, and the like. The eddy-current loss varies depending upon the specific resistance for the soft magnetic material, and the degree of integrity of the insulating film. From such viewpoints, the following techniques for obtaining bodies formed from insulated soft magnetic metal powder have been proposed.

The patent literature 1 discloses a method for manufacturing soft magnetic members by a powder metallurgy technique. The iron particles are wrapped with an insulating phosphate layer, and then compressed, which is followed by applying a heat treatment to them at a heat treatment temperature with an upper limit of 600 deg C., in an oxidizing atmosphere.

In the patent literature 2, a method for compression molding iron powder and applying a heat treatment thereto in order to obtain magnetic core members having improved soft magnetism is disclosed. The iron powder is made up of fine particles which are insulated by a thin layer of low phosphor content. According to the patent literature 2, the compression molded iron powder is subjected to a heat treatment at a temperature of 350 to 550 deg C. in an oxidizing atmosphere. According to the same invention, the heat treatment should be carried out at a temperature of 350 to 550 deg C., preferably at 400 to 530 deg C., and the most preferably at 430 to 520 deg C., however, the invention as disclosed in the patent literature 2 does not surpass the invention according to the patent literature 1.

The invention according to patent literature 3 specifies that, in order to obtain a compacted core of a ferromagnetic metal powder that has reduced eddy-current loss and has mechanical strength, phosphoric acid be deposited on the surface of the ferromagnetic metal particles, and the ferromagnetic metal powder be subjected to pressurized forming, and heat treatment at 300 to 600 deg C., preferably at 400 to 500 deg C.

The invention according to patent literature 4 provides a method for manufacturing a composite magnetic material obtained by compression molding a mixture made up of a magnetic powder and an insulation material, and then carrying out heat treatment, wherein the heat treatment is carried out two or more times, and if the oxygen concentration in the atmosphere for the first heat treatment is designated P1, and the oxygen concentration in the atmosphere for the second heat treatment is designated P2, by meeting the relationship P1>P2, a composite magnetic material which is low in core loss and high in magnetic permeability, and has an excellent DC bias characteristic is obtained. If the first heat treatment temperature is designated T1 and the second heat treatment temperature is designated T2, the relationship of T1<T2 should be met, and for oxygen concentration, the relationships, 1%<_P1<__30%, and P2<__1% should be met. For heat treatment temperature, the relationships, 150 deg C.<_T1<__500 deg C., and 500 deg C.<_T2<__900 deg C. should be met. In the first heat treatment, an oxidation insulating film is formed, and in the second high temperature heat treatment, stress be relieved. However, at the time of the second high temperature heat treatment, there is a possibility that the difference in thermal expansion coefficient between the magnetic powder and the oxidation insulating film may destroy the insulating film.

The invention according to the patent literature 5 provides a coated iron-based powder with which the surface of the iron-base powder particles is coated with a coating material, wherein the amount of the coating material for the coated iron-base powder is 0.02 to 10% by mass, and the coating material is made up of glass of 20 to 90% by mass, and a binder of 10 to 70% by mass, or alternatively insulating and heat-resistant substances, other than the glass and binder, of 70% or less. The binder is preferably made up of one type or two or more types selected from silicone resin, a metal phosphate compound, and a silicate compound. No claims directed towards heat treatment are given, but in the examples, a nitrogen gas atmosphere is used at a maximum temperature of 700 deg C.

The invention according to the patent literature 6 provides a composite magnetic material comprising a plurality of composite magnetic particles having metal magnetic particles and an insulation film surrounding the surface of the metal magnetic particles, wherein the plurality of composite magnetic particles are bound to one another, and the metal magnetic particles are made up only of a metal magnetic material, and impurities in proportion of the metal magnetic particles of 120 ppm or lower. It is specified that the composite magnetic material obtained by pressure molding be subjected to stabilization heat treatment at a temperature of from 200 deg C. to the thermal decomposition temperature for the resin added, in an oxidizing atmosphere or an inert gas atmosphere.

Patent literature 1: Germany Patent No. 3439397

Patent literature 2: Japanese National-Phase Publication No. 9-512388/1997

Patent literature 3: Japanese Patent Laid-Open Publication No. 7-245209/1995

Patent literature 4: Japanese Patent Laid-Open Publication No. 2000-232014

Patent literature 5: Japanese Patent Laid-Open Publication No. 2004-143554

Patent literature 6: Japanese Patent Laid-Open Publication No. 2005-15914

DISCLOSURE OF THE INVENTION

Problem to be Solved by the Invention

For higher magnetic permeability, it is necessary to reduce the thickness of the insulating film, and for lower hysteresis loss, it is required to relieve the working stress at the time of the compacting and molding, for which it is effective to carry out the heat treatment at a temperature of 700 deg C. or above, however, with the conventional methods represented by the above-mentioned patent literature I to patent literature 6, the thin insulating film is destroyed by the high temperature heat treatment, resulting in the eddy-current loss being increased.

Means to Solve the Problem

The purpose of the present invention is to provide a method for manufacturing bodies formed from insulated soft magnetic metal powder which are low in iron loss, high in magnetic permeability, and high in mechanical strength. In other words, the present invention solves the above-mentioned problem by providing a method for manufacturing bodies formed from insulated soft magnetic metal powder that is made up of the following aspects:

<1> The aspect 1 provides a method for manufacturing bodies formed from insulated soft magnetic metal powder by forming an insulating film of an inorganic substance on the surface of particles of a soft magnetic metal powder, compacting and molding the powder, then carrying out a heat treatment to provide a body formed from insulated soft magnetic metal powder, the method comprising: compacting and molding the powder; then, magnetically annealing the powder at a high temperature above the Curie temperature for the soft magnetic metal powder and below the threshold temperature at which the insulating film is destroyed, in a non-oxidizing atmosphere, such as a vacuum, inert gas, or the like; and then carrying out a further heat treatment at a temperature of from 400 deg C. to 700 deg C. in an oxidizing atmosphere, such as air, or the like.

<2> The aspect 2 provides the method for manufacturing bodies formed from insulated soft magnetic metal powder of the aspect I, wherein the soft magnetic metal powder substantially comprises one or more type of powder selected from: iron; ferrous alloys, such as iron-nickel alloy, iron-nickel-molybdenum alloy, iron-nickel-silicon alloy, iron-silicon alloy, iron-silicon-aluminum alloy, and the like; and ferrous amorphous alloys, such as iron-silicon-boron, or the like.

<3> The aspect 3 provides the method for manufacturing bodies formed from insulated soft magnetic metal powder of the aspect 1 or the aspect 2, wherein the insulating film substantially comprises iron phosphate before the heat treatments, and has been substantially changed to iron oxide after the heat treatments, and the powder comprises at least one type of metal oxide selected from metal oxides such as aluminum oxide, magnesium oxide, silicon oxide, zirconium oxide, and the like.

<4> The aspect 4 provides the method for manufacturing bodies formed from insulated soft magnetic metal powder of any one of the aspect 1 to the aspect 3, wherein the soft magnetic metal powder has an average particle diameter D50 of 10 μm to 150 μm.

<5> The aspect 5 provides the method for manufacturing bodies formed from insulated soft magnetic metal powder of any one of the aspect 1 to the aspect 4, wherein the thickness of the insulating film by the inorganic substance is 0.01 μm to 1 μm.

<6> The aspect 6 provides the method for manufacturing bodies formed from insulated soft magnetic metal powder of any one of the aspect 1 to the aspect 5, wherein the compacting and molding is carried out at a pressure of 5 to 20 t/cm$^2$ using any one or more of cold, hot, cold isostatic pressing, and hot isostatic pressing processes.

Effects of the Invention

According to the present invention, bodies formed from insulated soft magnetic metal powder which are low in iron loss, high in magnetic permeability, and high in mechanical strength can be stably manufactured.

BEST MODE FOR CARRYING OUT THE INVENTION

In the present invention, soft magnetic metal powder is made up of one or more types of: iron; ferrous alloys, such as iron-nickel alloy, iron-nickel-molybdenum alloy, iron-nickel-silicon alloy, iron-silicon alloy, iron-silicon-aluminum alloy, and the like; or ferrous amorphous alloys, such as iron-silicon-boron, or the like; Because these soft magnetic metal powders are high in saturation magnetic flux density and magnetic permeability, and low in coercive force, they are well suited for use as a high magnetic-permeability material, and a low iron-loss material. In addition, they are easily available as atomized powder and pulverized powder.

In the present invention, among the soft magnetic metal powders, iron, iron-nickel alloy, and iron-nickel-silicon alloy powders are particularly preferable from the viewpoints of low coercive force and high saturation magnetic flux density. In addition, it is preferable that the soft magnetic metal powder be flat and elongated in particle shape, and by rendering the particle shape flat and elongated, the demagnetization coefficient in the direction of the particle major axis can be reduced, and the magnetic permeability can be increased.

The soft magnetic metal powder preferably has an average particle diameter D50 of 10 μm to 150 μm. If the average particle diameter D50 for the soft magnetic metal powder is under 10 μm, the hysteresis loss may be difficult to reduce, and if the value of D50 exceeds 150 μm, it is relatively large compared to the skin depth for the high-frequency current induced, thus eddy-current loss may be increased.

In the present invention, on the surface of the particles of the above-mentioned soft magnetic metal powder, an insulating film by an inorganic substance is formed. The inorganic substance is preferably a substance which, before the heat treatment, is mainly made up of iron phosphate, and after the heat treatment, has been changed mainly into iron oxide, containing at least one type of metal oxide selected from the metal oxides, such as aluminum oxide, magnesium oxide, silicon oxide, zirconium oxide, and the like.

As an example of ingredient of the substance which, before the heat treatment, is mainly made up of iron phosphate, and after the beat treatment, has been changed mainly into iron oxide, phosphoric acid can be mentioned; phosphoric acid reacts with the iron ingredient in iron powder, a ferrous alloy powder, or a ferrous amorphous powder, which is a soft magnetic metal powder, to be changed into iron phosphate, and this iron phosphate is changed into iron oxide in the succeeding heat treatment process. In addition, as an alternative to phosphoric acid, a phosphate, such as magnesium phosphate, zinc phosphate, or the like, may be used.

The amount of addition of phosphoric acid or a phosphate to the soft magnetic metal powder is adjusted such that the thickness of the insulating film by the inorganic substance finally manufactured is 0.01 μm to 1 μm, and preferably 0.1 μm to 0.5 μm. If the thickness of the insulating film by the inorganic substance is under 0.01 μm, the insulating film may be dielectrically broken down below the Curie temperature, and if the thickness of the insulating film by the inorganic substance exceeds 1 μm, the magnetic permeability may be lowered, resulting in the magnetomotive force to obtain the necessary magnetic flux density being increased, which leads to an increase in current.

After phosphoric acid, or the like, being added to the soft magnetic metal powder, and dried to form an iron phosphate film, a metal oxide is preferably added to the soft magnetic metal powder with which an iron phosphate film has been formed. As the metal oxide, at least one type of metal oxide selected from the metal oxides, such as aluminum oxide, magnesium oxide, silicon oxide, zirconium oxide, and the like is preferable. Among these metal oxides, aluminum oxide is particularly preferable from the viewpoint of insulation characteristic (specific resistance) at high temperature. Further, in order to increase the strength, a low-melting point glass may be added.

The amount of a metal oxide for the soft magnetic metal powder with which an iron phosphate film has been formed is preferably 0.1 to 4% by mass, and more preferably 0.5 to 3% by mass relative to the total mass of soft magnetic metal powder. If the amount of a metal oxide for the soft magnetic metal powder with which an iron phosphate film has been formed is under 0.1% by mass, dielectric breakdown may be caused below the Curie temperature, and if it exceeds 4% by mass, the magnetic permeability may be lowered.

In addition, to the soft magnetic metal powder with which an iron phosphate film has been formed, a lubricant maybe added besides the metal oxide. By adding the lubricant, possible damage to the soft magnetic metal powder in the compacting and molding process later described can be prevented. Examples of the lubricant include metal stearates, paraffins, and waxes. The amount of lubricant for the soft magnetic metal powder with which an iron phosphate film has been formed may be 0.1 to 1% by mass or so.

Next, the soft magnetic metal powder is compacted and molded. As the compacting and molding method, any of the methods which are generally used in the powder metallurgy field, such as the cold, the hot, cold isostatic pressing (CIP), hot isotstatic pressing (HIP), and the like, can be used for easy forming the powder. The molding pressure is preferably 5 to 20 t/cm$^2$, and more preferably is 7 to 15 t/cm$^2$. This is because, if the molding pressure is under 5 t/cm2, the molding strength will be insufficient, resulting in the handling being difficult, and as the molding pressure exceeds 20 t/cm$^2$, the density converges to a point where no increase can be expected, and rather there arises the possibility of the insulating film being destroyed. By the compacting and molding method, the soft magnetic metal powder is formed to a geometry in accordance with the purpose, for example, a ring-like shape.

Next, the compacted molded body obtained as above is first subjected to the process of magnetic annealing at a high temperature, above the Curie temperature for the soft magnetic metal powder and below the threshold temperature at which the insulating film is destroyed, in a non-oxidizing atmosphere, such as vacuum, an inert gas, or the like. In this process, for the vacuum atmosphere, the oxygen partial pressure is preferably adjusted to $10^{-4}$ Pa to $10^{-2}$ Pa, and for the inert gas, there is no particular restriction, but an argon gas or nitrogen gas atmosphere is preferable.

In the present invention, by carrying out a first heat treatment (the magnetic annealing, i.e., the working stress relieving) at a high temperature above the Curie temperature for the soft magnetic metal powder and below the threshold temperature at which the insulating film is destroyed, the coercive force is lowered and the iron loss is reduced with the insulation being maintained. The heat treatment above the Curie temperature in a non-oxidizing atmosphere is effective for reduction in coercive force, however, the Curie temperature for a magnetically-soft metal varies depending upon the metal, and the Curie temperature for iron and iron-silicon alloys, for example, which are typical as the soft magnetic metal powder, are from 690 deg C. to 770 deg C. Therefore, when iron or iron-silicon alloy is used as the soft magnetic metal, it is required that the heat treatment be carried out at a temperature more than the range of 690 deg C. to 770 deg C.

In order to lower the coercive force and reduce the iron loss while maintaining the insulation with certainty, the heat treatment temperature is preferably the Curie temperature+80 deg C. for the soft magnetic metal powder; is further preferably the Curie temperature+100 deg C. for the soft magnetic metal powder; and is more preferably the Curie temperature+200 deg C. for the soft magnetic metal powder. The heat treatment time is preferably 30 to 300 min, and is more preferably 60 to 180 min. If the heat treatment time is under 30 min, the work stress may not be sufficiently relieved.

In the present invention, it is conjectured that, when the insulating film coupled with the soft magnetic metal powder is changed in quality by the first heat treatment (the magnetic annealing, i.e., the working stress relieving), the insulating films on the surfaces of adjacent soft magnetic metal particles are integrated structurally, and the heat-resistant metal oxide in the insulating film, that has a melting point above the first heat treatment temperature, prevents the soft magnetic metal particles from being contacted with each other to electrically conduct when they are moved and molded, thus providing an insulating film which is structurally integrated.

Next, after the first heat treatment process, the heat treated item is further subjected to a process (a second heat treatment process) in which it is heat treated at a temperature of from 400 deg C. to below 700 deg C. in an oxidizing atmosphere, such as air, or the like. In the second heat treatment process, the most preferable oxidizing atmosphere is air from the viewpoint of practical use, and besides this, a nitrogen gas atmosphere having an oxygen content of 10% or so maybe used.

The second heat treatment process is a beat treatment which subjects the insulating film structurally integrated in the first heat treatment process to an oxidation reaction for developing a more satisfactory insulation resistance and mechanical strength, thereby manufacturing body formed from an insulated soft magnetic metal powder which is low in iron loss and high in magnetic permeability. Although it varies depending upon the temperature conditions, in order to allow said oxidation reaction to thoroughly progress in the temperature range of from 400 deg C. to below 700 deg C., the heat treatment time is preferably at least 30 to 300 min, and is more preferably 60 to 180 min.

When the first heat treatment process is carried out with a high temperature heat treatment furnace, the second heat treatment process may be adapted such that, after completion of the first heat treatment process, the atmosphere in the high temperature heat treatment furnace of the annealing process is replaced with air, and the conditions for the second heat treatment process are satisfied, and in this case there is an advantage that the manufacturing process is simplified.

EXAMPLES

Hereinbelow, the present invention will be described further in detail by giving EXAMPLES, however, the present invention is not limited to these EXAMPLES.

Example 1

To permalloy PB based raw material powder having a particle size distribution of 10 to 150 μm, a phosphoric acid solution of 0.017% by mass relative to the raw material powder mass was added, and then the mixture was dried at room temperature for formation of an iron phosphate film of 1 pm or under. Into this, aluminum oxide powder of 2.4% by mass relative to the raw material powder mass was mixed. To the insulated soft magnetic metal powder obtained, zinc stearate as a lubricant was added at 0.5% by mass and mixed. This powder was placed in the die at room temperature, and pressed at a surface pressure of 15 t/cm$^2$ to obtain a "pressed item" in the shape of a ring.

This "pressed item" was subjected to the first heat treatment for a time period of 60 min at 950 deg C. in a non-oxidizing atmosphere, and then to the second heat treatment for a time period of 60 min at 500 deg C. in an oxidizing atmosphere.

Comparative Example 1

A "pressed item" in the shape of a ring was obtained in the same manner as in EXAMPLE 1. This "pressed item" was subjected to a heat treatment for a time period of 60 min at 500 deg C. in an oxidizing atmosphere. This represents the conventional general method for manufacturing a body formed from insulated soft magnetic metal powder.

Comparative Example 2

A "pressed item" in the shape of a ring was obtained in the same manner as in EXAMPLE 1. This "pressed item" was subjected to a first heat treatment for a time period of 60 min at 950 deg C. in a non-oxidizing atmosphere, and a second heat treatment was omitted.

Comparative Example 3

A "pressed item" in the shape of a ring was obtained in the same manner as in EXAMPLE 1. This "pressed item" was subjected to the "second" heat treatment for a time period of 60 min at 500 deg C. in an oxidizing atmosphere. Next, it was subjected to the "first" heat treatment for a time period of 60 min at 950 deg C. in a non-oxidizing atmosphere. In other words, the order of the heat treatments in EXAMPLE 1 was reversed.

Comparative Example 4

A "pressed item" in the shape of a ring was obtained in the same manner as in EXAMPLE 1. This "pressed item" was subjected to a heat treatment for a time period of 60 min at 600 deg C. in an oxidizing atmosphere.

Comparative Example 5

A "pressed item" in the shape of a ring was obtained in the same manner as in EXAMPLE 1. This "pressed item" was subjected to a heat treatment for a time period of 60 min at 700 deg C. in an oxidizing atmosphere.

(Evaluation Method)

For the samples obtained in EXAMPLE 1 and COMPARATIVE EXAMPLES 1 TO 5 the magnetic permeability, the iron loss, and the radial crushing strength were measured, Table 1 giving the results.

<Magnetic Permeability>

It was calculated from the inductance value at 1 kHz that was measured with an LCR HiTESTER 3532-50 manufactured by HIOKI E.E. CORPORATION, and the dimensional values for the "pressed item".

<Iron Loss>

The value at a magnetic flux density of 1 T, and a frequency of 1 kHz was measured with a B-H/μ Analyzer SY-8258 manufactured by IWATSU TEST INSTRUMENTS CORPORATION.

<Radial Crushing Strength>

It was measured by the method as defined in JIS Z 2507 "Sintered metal Bearing—Determination of radial crushing strength".

Table 1 gives the evaluation results

TABLE 1

| | | At magnetic flux density of 1 T, and frequency of 1 kHz | | | |
|---|---|---|---|---|---|
| | Magnetic permeability at 1 kHz | Hysteresis loss (W/kg) | Eddy-current loss (W/kg) | Iron loss (W/kg) | Radial crushing strength (MPa) |
| EXAMPLE 1 | 113 | 36.0 | 3.3 | 39.3 | 51 |
| COMP. EX. 1 | 70 | 202.1 | 0.6 | 202.7 | 53 |
| COMP. EX. 2 | 104 | 28.4 | 1.2 | 29.6 | 25 |
| COMP. EX. 3 | 133 | 76.4 | 119.0 | 195.4 | 51 |
| COMP. EX. 4 | 61 | 273.4 | 5.5 | 278.9 | 138 |
| COMP. EX. 5 | 70 | 236.7 | 141.8 | 378.9 | 97 |

From Table 1, the following considerations can be made.

(1) The iron loss in EXAMPLE 1 is as low as approximately ⅕ or so of that in COMPARATIVE EXAMPLE 1 Thus, it can be said that the iron loss reduction effect provided by carrying out the first heat treatment above the Curie temperature in the non-oxidizing atmosphere is remarkable. In addition, it can be understood that, regardless of the heat treatment at a temperature as high as 950 deg C., practically no increase in eddy-current loss was caused, and thus the insulation could be well maintained.

(2) It can be seen that the radial crushing strength in COMPARATIVE EXAMPLE 2, in which the second heat treatment carried out at a temperature below 700 deg C. in an oxidizing atmosphere was omitted, was lowered to approximately ½ of that in EXAMPLE 1, but there was no significant difference in iron lass and magnetic permeability.

(3) In COMPARATIVE EXAMPLE 3, in which the order of the heat treatments in EXAMPLE 1 was reversed, the insulation was rendered insufficient, and thus the eddy-current loss was increased to a value as high as approximately 36 times that in EXAMPLE 1, resulting in the iron loss being increased to approximately 5 times. From this, it can be recognized that, in the present invention, the order of the first heat treatment process and the second heat treatment process is important.

(4) Comparing the values of eddy-current loss in COMPARATIVE EXAMPLE 1, COMPARATIVE EXAMPLE 4, and COMPARATIVE EXAMPLE 5, in which the heat treatment temperature in the atmospheric air was 500 deg C., 600 deg C., 700 deg C., respectively, shows that the eddy-current loss in COMPARATIVE EXAMPLE 5 was greatly increased due to the dielectric breakdown at 700 deg C., and that, in the oxidizing atmosphere, such as air, or the like, the heat treatment temperature must be below 700 deg C.

INDUSTRIAL APPLICABILITY

The present invention is well suited for motor cores, toroidal cores, and the like, as electric/electronic components, that are required to be low in iron loss, high in magnetic permeability, and high in mechanical strength.

What is claimed is:

1. A method for manufacturing bodies formed from insulated soft magnetic metal powder, the method comprising:

forming an insulating film of an inorganic substance on the surface of particles of a soft magnetic metal powder to form an insulated soft magnetic metal powder;

compacting and molding the insulated soft magnetic metal powder to provide bodies;

heat treating the bodies formed from the insulated soft magnetic metal powder at a high temperature above the Curie temperature and below the threshold temperature at which the insulating film is destroyed in a non-oxidizing atmosphere; and carrying out a further heat treatment at a temperature of from 400° C. to 700° C. in an oxidizing atmosphere.

2. The method for manufacturing bodies formed from insulated soft magnetic metal powder of claim 1, wherein the soft magnetic metal powder substantially comprises one or more types of power selected from the group consisting of iron; ferrous alloys and ferrous amorphous alloys.

3. The method for manufacturing bodies formed from insulated soft magnetic metal powder of claim 1, wherein the insulating film substantially comprises iron phosphate before the heat treatments, and has been substantially changed to iron oxide after the heat treatments, and the insulating film comprises at least one metal oxide selected from the group consisting of aluminum oxide, magnesium oxide, silicon oxide, zirconium oxide.

4. The method for manufacturing bodies formed from insulated soft magnetic metal powder of claim 1, wherein the soft magnetic metal powder has an average particle diameter D50 of 10 μm to 150 μm.

5. The method for manufacturing bodies formed from insulated soft magnetic metal powder of claim 1, wherein the thickness of the insulating film by the inorganic substance is 0.01 μm to 1 μm.

6. The method for manufacturing bodies formed from insulated soft magnetic metal powder of claim 1, wherein the compacting and molding is carried out at a pressure of 5 to 20 $t/cm^2$ using any one or more of cold, hot, cold isostatic pressing, and hot isostatic pressing processes.

7. The method of manufacturing bodies formed from insulated soft magnetic metal powder of claim 2, wherein the soft magnetic metal powder has an average particle diameter D50 of 10 μm to 150 μm.

8. The method for manufacturing bodies formed from insulated soft magnetic metal powder of claim 2, wherein the thickness of the insulating film by the inorganic substance is 0.01 μm to 1 μm.

9. The method for manufacturing bodies formed from insulated soft magnetic metal powder of claim 2, wherein the insulating film substantially comprises iron phosphate before the heat treatments, and has been substantially changed to iron oxide after the heat treatments, and the insulating film comprises at least one metal oxide selected from the group consisting of aluminum oxide, magnesium oxide, silicon oxide, zirconium oxide.

10. The method for manufacturing bodies formed from insulated soft magnetic metal powder of claim 2, wherein the compacting and molding is carried out at a pressure of 5 to 20 $t/cm^2$ using any one or more of cold, hot, cold isostatic pressing, and hot isostatic pressing processes.

11. The method of claim 1, wherein said oxidizing atmosphere is air.

12. The method of claim 2, wherein the iron ferrous alloys are selected from the group consisting of iron-nickel alloy, iron-nickel-molybdenum alloy, iron-nickel-silicon alloy, iron-silicon alloy and iron-silicon-aluminum alloy.

13. The method of claim 2, wherein the ferrous amorphous alloy is iron-silicon-boron.

* * * * *